United States Patent [19]

Riedel

[11] Patent Number: 4,899,410

[45] Date of Patent: Feb. 13, 1990

[54] CONTINUOUS FABRIC TREATMENT PROCESS

[75] Inventor: Dieter Riedel, Porta Westfalica, Fed. Rep. of Germany

[73] Assignee: Johannes Menschner Maschinenfabrik GmbH & Co. KG, Viersen, Fed. Rep. of Germany

[21] Appl. No.: 59,613

[22] Filed: Jun. 8, 1987

[30] Foreign Application Priority Data

Sep. 10, 1986 [DE] Fed. Rep. of Germany ..... 3630716

[51] Int. Cl.[4] ..... D06B 5/08

[52] U.S. Cl. ..... 8/149.3; 8/151.1

[58] Field of Search ..... 8/149.3, 151.1; 68/5 R, 68/5 C, 5 D, 5 E; 34/115

[56] References Cited

U.S. PATENT DOCUMENTS

| | | | |
|---|---|---|---|
| 2,885,875 | 5/1959 | Sperotto | 68/20 X |
| 3,046,771 | 7/1962 | Bailey | 68/5 R |
| 3,188,837 | 6/1965 | Ondarza et al. | 8/149.3 X |
| 3,620,051 | 11/1971 | Riedel | 34/115 |
| 3,719,450 | 3/1973 | Burley | 8/149.3 X |
| 3,885,262 | 5/1975 | Riedel | 8/149.3 |
| 3,943,735 | 3/1976 | Riedel | 68/5 R |
| 4,030,320 | 6/1977 | Riedel | 68/58 |
| 4,102,643 | 7/1978 | Riedel | 8/149.3 |

FOREIGN PATENT DOCUMENTS

| | | | |
|---|---|---|---|
| 126142 | 7/1975 | Fed. Rep. of Germany . | |
| 2727514 | 12/1978 | Fed. Rep. of Germany | 68/5 R |
| 1389977 | 4/1975 | United Kingdom . | |
| 1424319 | 2/1976 | United Kingdom . | |

*Primary Examiner*—Frankie L. Stinson

*Attorney, Agent, or Firm*—Penrose L. Albright; Robert A. Miller

[57] ABSTRACT

In a fabric treatment process, the fabric is subjected to a decatizing finishing step using a steaming and suction cylinder immediately after it has been subjected to a treatment step in which the fabric is pressed and fixed on a steaming cylinder.

1 Claim, 1 Drawing Sheet

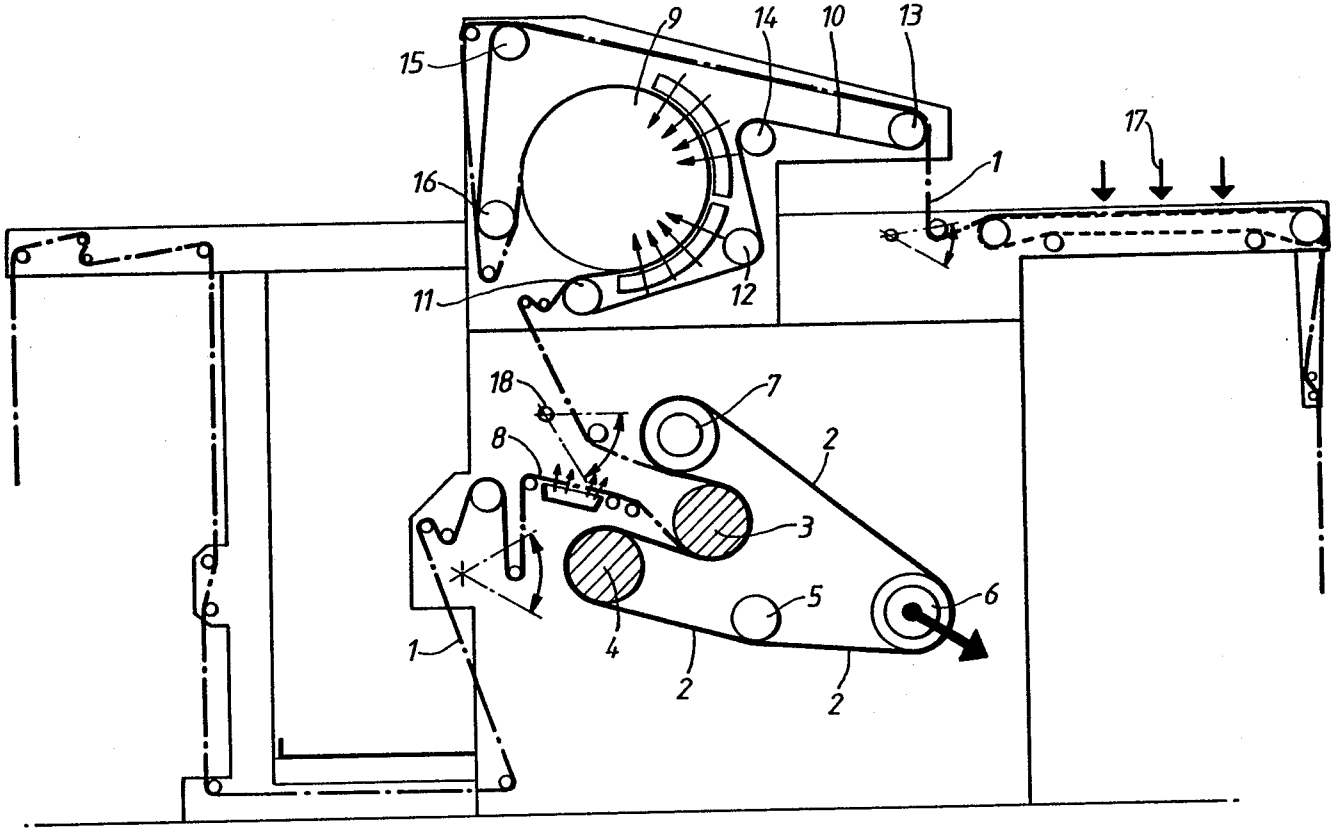
17
1
13
10
14
9
15
16
11
12
18
8
7
2
3
4
5
6
2
2
1

CONTINUOUS FABRIC TREATMENT PROCESS

BACKGROUND OF THE INVENTION

1. Technical Field

The present invention relates to a process for the continuous treatment of fabrics, including woven or knitted fabrics. The invention relates to the type of processing in which the fabric is subjected to a pressing and fixing step using a heatable steaming cylinder, and, subsequently, to a decatizing finishing step using a steaming and suction cylinder.

2. Prior Art

In existing implementations of this type of fabric treatment process, the fabric to be treated is pressed and fixed by passing it around a heated, steaming cylinder beneath a thrust belt. The fabric is then cooled and passes into an intermediate store, from which it is subsequently withdrawn in order to be subjected to a decatizing finishing treatment, after which it must be cooled again.

It is necessary for the fabric to be thoroughly cooled before it is stored in order to prevent the formation of pleats in the fabric as it is folded for storage. This type of process is time consuming and expensive, because of the energy requirements of the repeated heating and cooling steps.

SUMMARY OF THE INVENTION

It is an object of the invention to provide a continuous fabric treatment process which takes less time and is less expensive. In accordance with the process of the present invention, the fabric to be treated is subjected to the decatizing finishing step immediately in time after the pressing and fixing step.

By eliminating the intermediate storage step, considerable cost savings are achieved. Moreover, the flow of fabric through the processing apparatus is considerably simplified.

It is also found that the overall effect of the fabric treatment is improved relative to the prior art process.

The apparatus required for implementing the process of the present invention needs less space than the prior art apparatus, and less personnel are required to control the process. The reduction in space can be achieved because the transportation path for the fabric being treated is shorter than in the prior art apparatus. So that the decatizing finishing treatment of the fabric can achieve the best effect, it is desirable for the fabric to be hot and moist as it enters the decatizing device so that it can be passed immediately around the steaming and suction cylinder without any preceding treatment stages in order to heat the fabric to the evaporation temperature. The elimination of such preceding stages means that the effectiveness and rate of treatment can be increased considerably relative to the prior art process.

Due to the elimination of intermediate cooling and heating steps, the energy requirements for the process of the present invention are substantially reduced relative to the prior art process.

In order to ensure that the fabric is not subjected to excess stress between the pressing and fixing steps and the decatizing finishing step, it is possible to provide a compensating roller in the fabric path between the devices for carrying out these steps in order to provide for automatic adjustment of the drive of the steaming and suction cylinder.

A continuous fabric treatment process in accordance with the invention will now be described by way of example.

BRIEF DESCRIPTION OF THE DRAWING

The FIGURE shows a schematic cross-sectional representation of apparatus for carrying out the process.

DESCRIPTION OF A PREFERRED EMBODIMENT

The strip of fabric 1 to be treated is guided over a series of rollers into a pressing and fixing device which consists of a heatable cylinder 3 around which the fabric is passed. The fabric 1 is pressed into contact with the surface of the cylinder 3 by means of a thrust belt 2 which passes around rollers 4, 5, 6, and 7. The roller 4 is heatable in order to heat the thrust belt to the required temperature according to the effect to be achieved on the fabric. The roller 6 can be adjusted to tension the pressure in the thrust belt 2, and the roller 7 is a drive roller.

The fabric 1 passes over a steaming table 8 before it passes around the cylinder 3, in order to ensure that the fabric has the required moisture content prior to pressing and fixing in order to achieve the desired result.

In accordance with the essential step of the process of the invention, the fabric 1 is fed directly out of the pressing and fixing device and immediately fed into a decatizing finishing device, which is located downstream of the pressing and fixing device, without intermediate storage or time delay. As illustrated the decatizing finishing device comprises a steaming and suction cylinder around which the fabric is passed underneath a thrust belt 10. The thrust belt 10 is guided over rollers 11–16 so as to press the fabric 1 against the steaming and suction cylinder 9.

After exiting the decatizing finishing device, the fabric is cooled in a cooling device 17 and passed to a folder as finished goods.

Reference numeral 18 designates a compensating roller, by means of which automatic adjustment of the drive to the steaming and suction cylinder is carried out in order to ensure that the fabric is not subjected to excessive stress as it passes from the pressing and fixing device to the decatizing finishing device.

I claim:

1. A process for continuous treatment of fabric, including the steps of pressing and fixing the fabric by passing it around a heatable cylinder beneath a heated thrust belt, and decatizing finishing the fabric by passing it around a steaming and suction cylinder, the decatizing finishing step being carried out immediately in time after the pressing and fixing step.

* * * * *